United States Patent [19]

Tönsmann et al.

[11] Patent Number: 4,790,583

[45] Date of Patent: Dec. 13, 1988

[54] ACTUATING ARRANGEMENT FOR WINDOW CASEMENT OR DOOR LEAF FITTINGS

[75] Inventors: Armin Tönsmann; Bernd Diekmann, both of Bielefeld, Fed. Rep. of Germany

[73] Assignee: Schueco Heinz Schuermann GmbH & Co., Bielefeld, Fed. Rep. of Germany

[21] Appl. No.: 943,630

[22] Filed: Dec. 18, 1986

[30] Foreign Application Priority Data

Dec. 23, 1985 [DE] Fed. Rep. of Germany ..... 3545859

[51] Int. Cl.[4] ..... E05C 21/02

[52] U.S. Cl. ..... 292/336.3; 292/DIG. 47

[58] Field of Search ..... 292/336.3, 37, 140, 292/169, DIG. 20, DIG. 47, 98, 124, 170, 347

[56] References Cited

U.S. PATENT DOCUMENTS 2,757,032 7/1956 Stieglitz ..... 292/140 X

FOREIGN PATENT DOCUMENTS 0143237 6/1985 European Pat. Off. ..... 292/37
2706013 8/1978 Fed. Rep. of Germany ... 292/DIG. 20
2935667 3/1981 Fed. Rep. of Germany ... 292/336.3
3032527 3/1982 Fed. Rep. of Germany ... 292/336.3
3203311 8/1983 Fed. Rep. of Germany ... 292/336.3
2347512 12/1977 France ..... 292/DIG. 20
208121 10/1966 Sweden ..... 292/336.3
2028415 3/1980 United Kingdom ..... 292/36
2069586 8/1981 United Kingdom ..... 292/336.3
2156896 10/1985 United Kingdom ..... 292/37

*Primary Examiner*—Richard E. Moore
*Attorney, Agent, or Firm*—Laubscher & Laubscher

[57] ABSTRACT

An actuating handle arrangement for the actuation of fittings of a window casement or a door leaf includes an actuating handle which is mounted for turning about a turning axis on a housing which is secured to a window casement or door leaf frame. The actuating handle operates a pusher bar fitting which is coupled with an entraining member of a slide which is mounted in the housing for displacement in the longitudinal direction. The slide is provided with a guiding groove, in which there engages an entraining pin of an eccentric which is connected with the actuating handle. In the end positions of the actuating handle which correspond to the closing and the tilting position of the window casement, the line connecting the intersection point of the turning axis and the intersection point of a central axis of the entraining point with an imaginary plane along which the slide moves extends at right angles to the central longitudinal axis of the guiding groove.

17 Claims, 5 Drawing Sheets

Fig.1
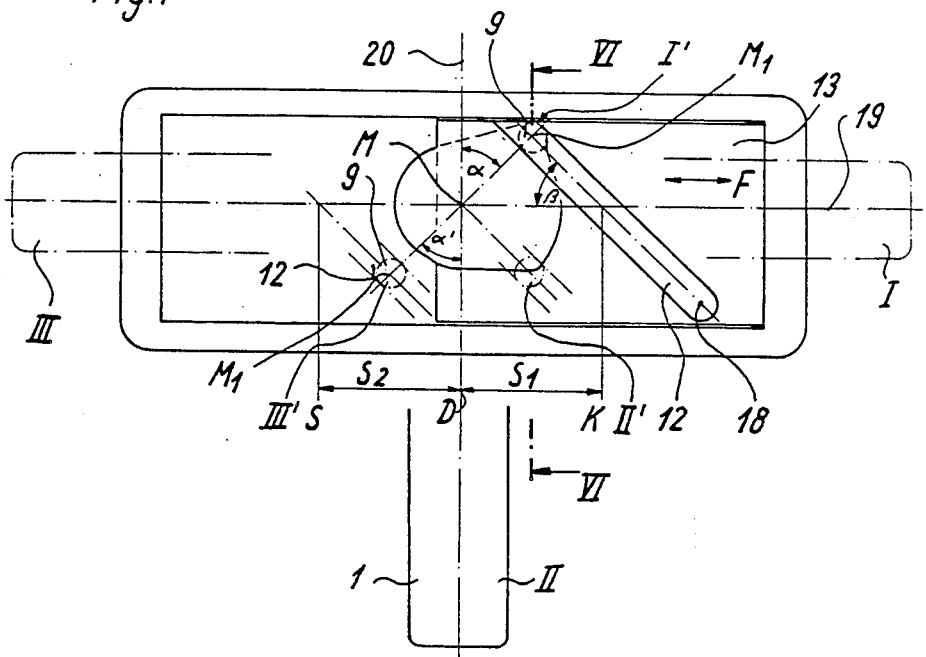
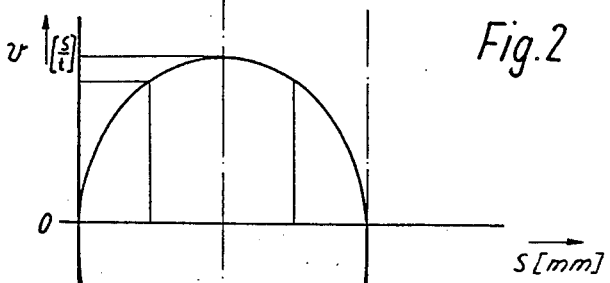
Fig.2
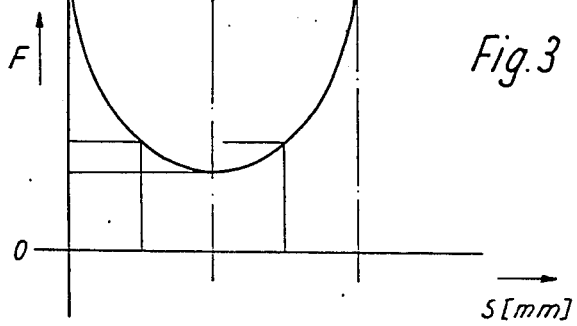
Fig.3

Fig. 6
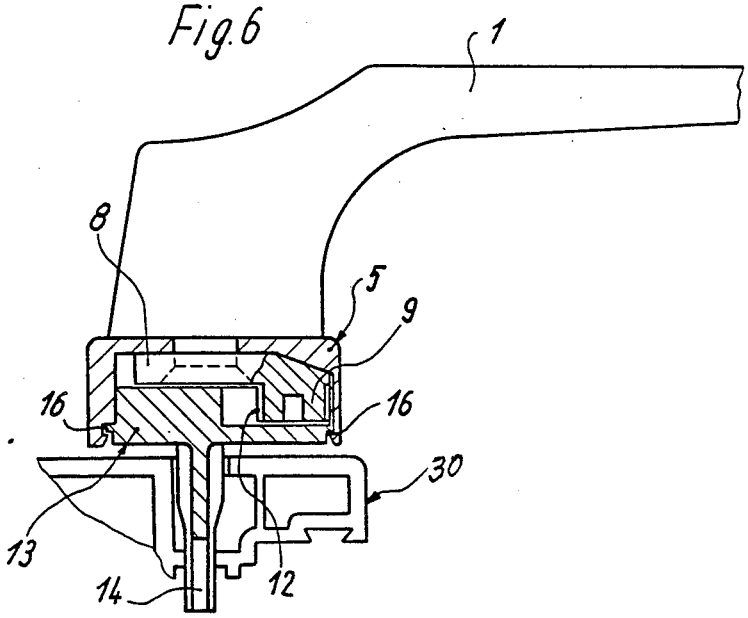
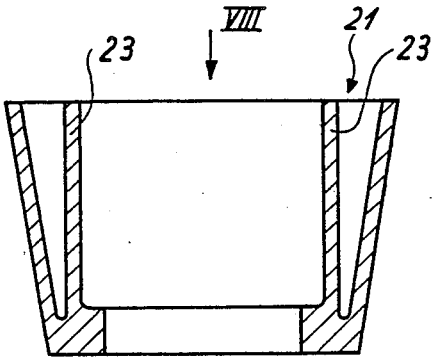
Fig. 7
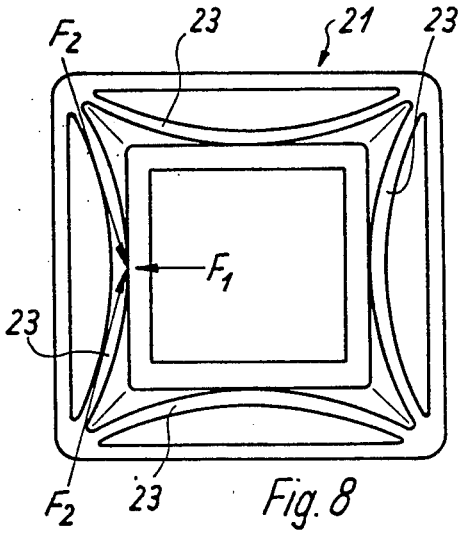
Fig. 8

ACTUATING ARRANGEMENT FOR WINDOW CASEMENT OR DOOR LEAF FITTINGS

BACKGROUND OF THE INVENTION

The present invention relates to actuating arrangements for door fittings in general, and more particularly to actuating arrangements for fittings of turnable, tiltable, or turnable and tiltable window casements or door leaves.

There are already known various constructions of arrangements for actuating the window or door fittings of turnable, tiltable or turnable and tiltable window casements or door leaves, among them such which include an actuating handle which is turnably mounted on a housing that is secured to a respective window casement or door leaf frame, while a transmission which is actuated by the actuating handle is arranged in the interior of the housing and includes a driving element which is connected with an entraining member that is coupled with a pusher bar of a pusher-rod fitting.

So, for instance, there is already known an arrangement of the above type in which a gear pinion is rotatably mounted on a bearing bolt which extends into the housing. The gear pinion meshes with a gear rack which is guided in the housing and by means of which an entraining member that is coupled with a pusher bar. For the guidance of the gear rack, the housing is closed at its lower side by a lid. The grip can be lifted from the housing against the force of a spring in the direction of the axis of rotation, in order to release an arresting connection between the grip and the housing and then to turn the grip into another switched position. For the arresting connection between the grip and the housing, a limiting surface of the grip which faces the housing is provided with arresting cams which engage in arresting recesses of an annular flange of a synthetic plastic material sleeve which is secured t the housing and in which the bearing bolt of the grip is supported for turning about its axis.

This known actuating handle arrangement has the property that, when the angular speed of the actuating handle is constant, the stroke speed of its entraining member is also constant. However, when the force acting on the actuating handle is constant, the force which is transmitted by the actuating member to the pusher bar is also constant.

The stroke of the known transmission depends on the radius of the pitch circle of the gear pinion. An increase in the stroke can only be achieved by increasing the radius of the pitch circle, so that structural difficulties are encountered in the housing.

SUMMARY OF THE INVENTION

Accordingly, it is a general object of the present invention to avoid the disadvantages of the prior art.

More particularly, it is an object of the present invention to provide an actuating handle arrangement for door or window fittings, which does not possess the drawbacks of the known arrangements of this type.

Still another object of the present invention is to devise an arrangement of the type here under consideration which would render it possible to change the stroke while maintaining the housing dimensions.

It is yet another object of the present invention to design the above arrangement in such a manner as to avoid the axial movability under the influence of a spring force.

A concomitant object of the present invention is so to construct the actuating arrangement of the above type as to be relatively simple in construction, inexpensive to manufacture, easy to use, and yet reliable in operation.

In keeping with these objects and others which will become apparent hereafter, one feature of the present invention resides in an arrangement for actuating door or window fittings of a turnable and/or tiltable door leaf or window casement structure, which are operated by a pusher bar. This arrangement comprises a housing having a longitudinal axis and mounted on the structure in a mounted condition of the arrangement. An actuating handle is mounted on the housing for turning about a turning axis. A transmission is accommodated in the housing and actuated by the actuating handle. The transmission includes a slide centered on a central longitudinal axis, mounted in the housing for displacement along the longitudinal axis of the housing, and having an elongated guiding groove centered on a longitudinal groove axis extending at an acute angle with respect to the central longitudinal axis of the slide. The transmission further includes an eccentric connected to the actuating handle and equipped with an entraining pin which is received in the guiding groove of the slide for movement longitudinally of the guiding groove, and an entraining member secured to the slide and coupled with the pusher bar in the mounted condition.

According to a currently preferred concept of the present invention, the entraining pin has a central axis, the slide extends along an imaginary plane which is intersected by the turning and central axes at respective intersection points, and the actuating handle is turnable between two end positions thereof corresponding to the closed and tilting position of the structure. These end positions are spaced from one another by 180° and in each of them a connecting line which interconnects the intersection points extends at a right angle with respect to the longitudinal groove axis.

A particular advantage of the construction as described so far is that, while in the known actuating handle arrangements the force which is transmitted from the entraining member to the pusher bar remains constant over the entire stroke of the entraining member, it is achieved in the arrangement according to the present invention that, at a constant manual force applied to the actuating handle, a maximum force is transmitted from the entraining member to the pusher bar in the end positions of the transmission which correspond to the closing and the tilting positions of the window casement.

It is particularly advantageous when the actuating handle includes a cylindrical bearing bolt centered on the turning axis and having a free end, and an axial pin extending beyond the free end of the bearing bolt, having a diameter smaller than the bearing bolt, and provided with external circumferential gear toothing, and when the eccentric includes a receiving bore for receiving the axial pin, the bore being provided with an internal circumferential gear toothing corresponding to the external gear toothing of the axial pin.

Advantageously, the actuating handle includes a cylindrical bearing bolt centered on the turning axis and having a free end, and the housing is provided with an integral bearing sleeve which is provided with a bearing bore for the bearing bolt and conically tapers toward the free end. In this context it is advantageous when the actuating handle further includes an axial pin extending beyond the free end of the bearing bolt, and when the transmission further includes a clamping disk mounted on the axial pin and having an outer edge portion which is in contact with the eccentric, and a screw which connects the clamping pin to the bearing bolt. Each of the housing with the integral bearing sleeve, the actuating lever with the bearing bolt and the axial pin, the slide with the entraining member, and the eccentric, is advantageously of a synthetic plastic material.

According to another advantageous aspect of the present invention, there may further be provided a key element of a synthetic plastic material arranged between the bearing sleeve of the housing and the actuating handle and connected to the actuating handle, the key element including resilient arcuate inwardly bulging wall portions which engage the bearing sleeve of the housing. The key element may advantageously have a polygonal, especially cross-sectionally square, outer contour, and the actuating handle is provided with a corresponding polygonal recess at the region of the bearing bolt. The polygonal recess is advantageously trapezoidal in axial section.

It is particularly advantageous when the key element has outer surfaces and the polygonal recess is bounded by inner surfaces, and when there is further provided an adhesive layer connecting the inner and outer surfaces. Advantageously, the bearing sleeve is provided with arresting recesses at locations which are spaced from one another by 90° for the engagement of the resilient wall portions.

According to another facet of the present invention, there is further provided a cap having an opening for the passage of the actuating handle therethrough, and means for arresting the cap to the housing. Such arresting means may advantageously include arresting recesses in the cap, and arresting tongues on the housing which engage in the arresting recesses of the cap.

An advantageous construction is obtained when the housing has longitudinally extending grooves, and when the slide has lateral longitudinal surfaces and includes guiding webs at the lateral longitudinal surfaces thereof, the guiding webs extending into the longitudinally extending grooves of the housing. In this connection, it is advantageous when the housing has arresting ledges which engage under the guiding webs of the slide. Last but not least, the transmission may further include a roller which is constituted by a metallic ring and is rotatably supported on the entraining pin.

BRIEF DESCRIPTION OF THE DRAWING

The present invention will be described below in more detail with reference to the accompanying drawing in which:

FIG. 1 is a bottom plan view of an actuating handle arrangement according to the present invention, with a diagrammatic representation of a transmission which is received in a housing;

FIG. 2 is a graphic representation of the dependence of speed on displacement in the arrangement of FIG. 1;

FIG. 3 is a graphic representation of the dependence of force on displacement in the arrangement of FIG. 1;

FIG. 6 is a sectional view taken on line VI—VI of FIG. 1;

FIG. 7 is an axial sectional view of a structural detail of FIG. 4;

FIG. 8 is a plan view taken in the direction of an arrow VIII of FIG. 7; and

DETAILED DESCRIPTION OF THE PREFERRED EMBODIMENT

Figure 4:
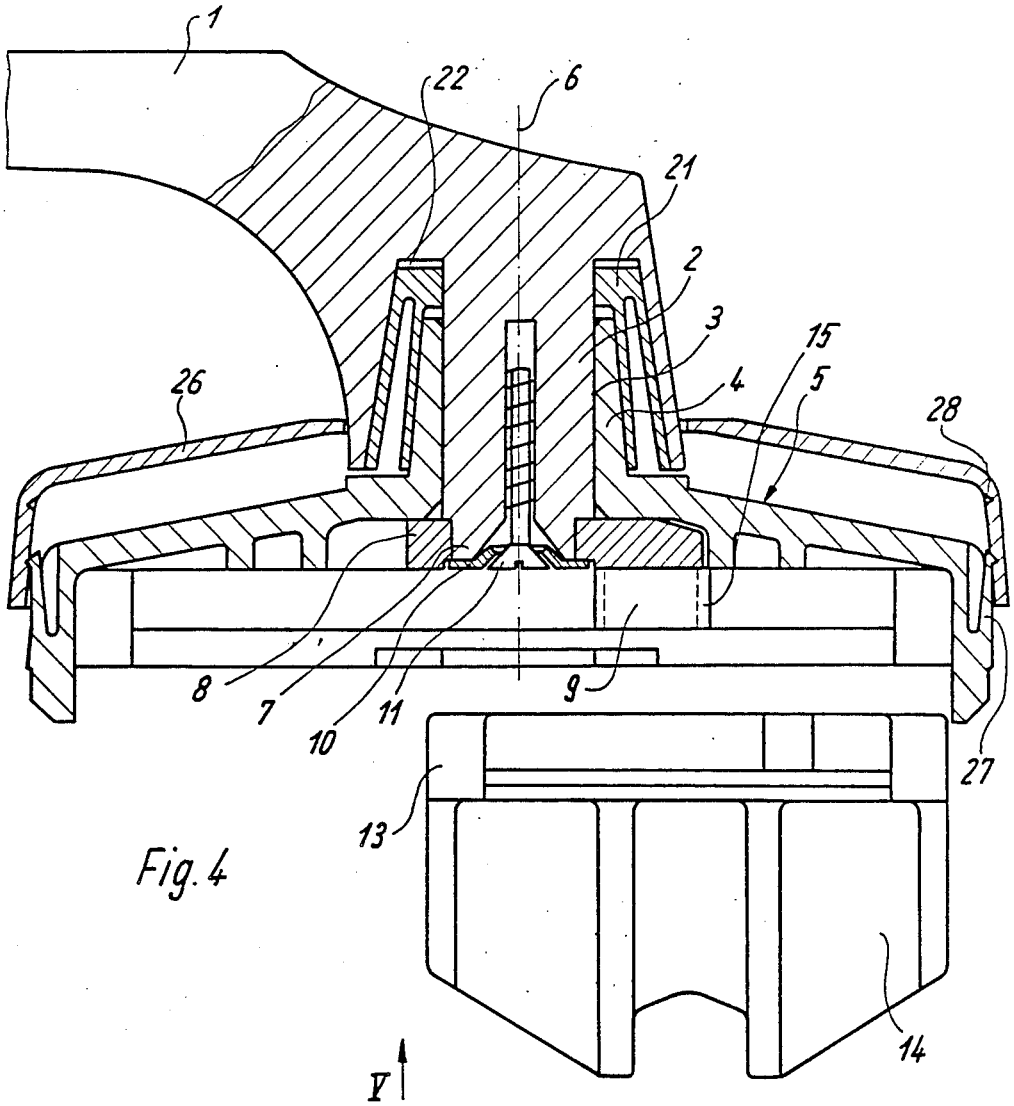
FIG. 4 is an axial section through the arrangement of FIG. 1.

Referring now to the drawing in detail, and first to FIG. 4 thereof, it may be seen that the reference numeral 1 has been used therein to identify a manually operatable actuating handle which is provided with a cylindrical bearing bolt 2. The bearing bolt 2 is turnably supported in a bearing bore 3 which is formed in a bearing sleeve 4 of a housing 5. The actuating handle 1 is turnable with respect to the housing 5 about an axis 6. The bearing bolt 2 has a free end that is remote from the actuating handle 1 and is provided at this free end with an integral axial pin 7 which has a smaller diameter than the bearing bolt 2 and is provided with a circumferential gear toothing This axial pin 7 extends into a receiving bore of an eccentric 8 that is equipped with an entraining pin 9. The receiving bore of the eccentric 8 is provided with a gear toothing which corresponds to or complements the circumferential gear toothing of the axial pin 7, so that the eccentric 8 is secured to the axial pin 7 for joint turning therewith but can be inserted into the receiving bore of the eccentric in different mutually angularly displaced positions. Securing of the eccentric 8 against axial displacement is achieved by means of a clamping disk 10 having an outer edge portion which is in contact with the eccentric 8. The clamping disk 10 is affixed to the bearing bolt 2 by means of a screw 11. As indicated particularly in FIGS. 1 and 6 of the drawing, the entraining pin 9 of the eccentric 8 is received in a guiding groove 12 of a slide 13 which is mounted for movement advantageously made of a synthetic plastic material. In this an entraining member 14, which is coupled with a pusher is advantageously of one piece with the slide 13.

As shown in FIG. 4, a roller 15, which is advantageously constructed and configured as a metallic ring, may be rotatably supported on the entraining pin 9.

In the illustrated construction in accordance with the invention, the slide 13 is provided at its longitudinal edge portions, as shown in FIG. 6, with guiding webs 16 which engage in angularly configured recesses of the housing 5.

Figure 5:
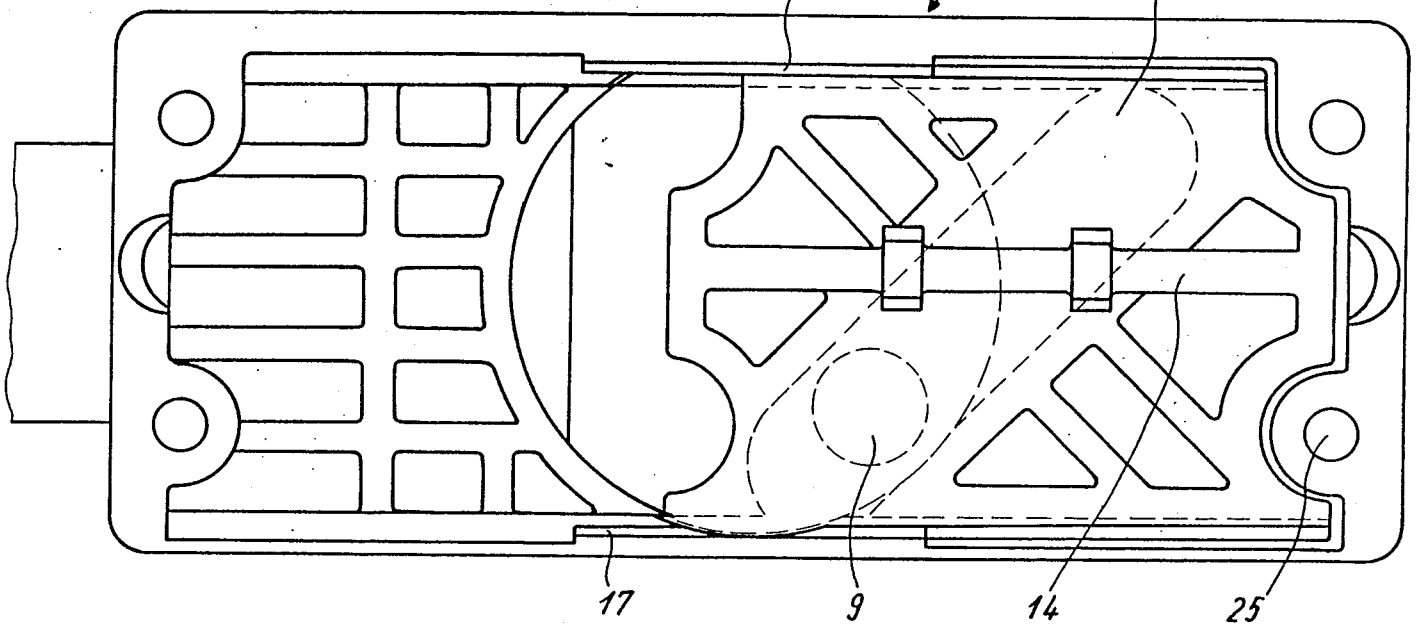
FIG. 5 is a bottom plan view of the housing with the entraining member received therein, taken in the direction of an arrow V of FIG. 4.

It may be ascertained from FIG. 5 of the drawing that the housing 5 is provided at its central region with arresting ledges 17 which engage under the guiding webs 16 of the slide 13. As a result of this construction, the slide 13 is held on the housing 5 before the housing 5 is connected to a profiled portion 30 of the window casement or door leaf frame. After the securing of the housing 5 to the window casement or door leaf frame portion 30, the entraining member 14 extends through a recess in the frame portion 30 all the way into a fitting accommodation groove of the frame portion 30.

The operating principle of the actuating handle arrangement according to the invention is illustrated in FIGS. 1 to 3 of the drawing. The actuating handle 1 may assume any one of its positions which are indicated by the reference numerals I, II and III in FIG. 1 and which are spaced from one another by 90°. In correspondence with these positions I, II and III, of the actuating handle 1, the entraining pin 9 assumes its positions I', II' and III', respectively. During its displacement between these switched positions I', II' and III', the entraining pin 9 slides in the guiding groove 12 of the slide 13 and thus accomplished displacement of the slide 13 in the housing 5. In the switched position I of the actuating handle 1, a central longitudinal axis 18 of the guiding groove 12 intersects a central longitudinal axis 19 of the housing 5 at a point K. Further positions of such intersection for the positions II and III of the actuating handle 1 are indicated by the reference characters D and S, respectively. The distance S-D is denoted as $S_2$. This distance $S_2$ is equal to the distance S-K which is denoted as $S_1$.

In the transmission according to FIG. 1, the forces which are in effect at the entraining member 14 are the highest in the switched positions I and III of the actuating handle 1, which correspond to the tilting and closed positions of the window, respectively. What is characteristic for this principle is that a straight line connecting a central point M of the actuating handle 1 with a central point $M_1$ of the entraining pin 9 is at right angles to the central longitudinal axis 18 of the guiding groove 12 in the positions I and III of the actuating handle 1. This means that an angle $\beta$ between the central longitudinal axis 19 of the housing and the central longitudinal axis 18 of the guiding groove 12 is equal to an angle $\alpha$ between the straight line connecting the points M and $M_1$ and a line 20 which is perpendicular to the central longitudinal axis 19 of the housing 5 at the point M, and to a corresponding angle $\alpha'$ in the positions I and III of the actuating handle 1, respectively.

FIG. 2 is a diagrammatic representation of the dependency of the speed of the entraining member 14 on the distance covered by the entraining member 14 during its displacement between its end positions while the actuating handle 1 is being displaced at a constant speed. It may be seen from this illustration that the speed of displacement of the entraining member 14 decreases toward zero as the actuating handle 1 approaches its positions I and III, and is at its maximum when the actuating handle 1 is in its central position II.

FIG. 3 graphically illustrates the dependency of a force F acting on the entraining member 14 on the distance covered by the entraining member 14 between its end positions while the torque applied to the actuating handle 1 is maintained constant. It may be seen that the driving force F acting on the entraining member 14 exhibits a maximum in the positions I and III of the actuating handle 1. On the other hand, the driving force F has a minimum in the position II of the actuating handle 1.

In the switched positions I and III of the actuating handle 1, the window casement is latched or unlatched so that it can be tilted. In these positions I and III of the actuating handle 1, there are to be overcome, in addition to pure frictional forces of the window fitting, also the applicable latching forces.

In the switched position II of the actuating handle 1, all latching elements between the window frame and the casement frame are disengaged. The casement frame is in its turning position, so that solely the friction forces of the fitting are to be overcome From the switched position II, there is obtained the advantage that the idle stroke of the transmission is rapidly bridged already within a relatively small tilting angle of the actuating handle 1.

It can be ascertained from the principle illustration of FIG. 1 that, by changing the position of the guiding groove 12 while the eccentricity of the entraining pin 9 is simultaneously being maintained the same as before, that is, by changing the angle $\beta$ there can be obtained a reduction or an increase in the stroke of the slide 13 or of the entraining member 14. A change in the stroke can also be obtained by changing the eccentricity of the entraining pin 9 while maintaining the angle $\beta$ the same as before.

When the position of the guiding groove 12 is changed, that is, when the angle $\beta$ is changed, it is also necessary to change the position of the eccentric 8 and thus the angle $\alpha$. As a consequence of the fact that the eccentric 8 is positively secured to the axial pin 7 via a gear toothing, there exists the possibility to adjust the eccentric 8 to the new geometry of the transmission stroke by simply withdrawing the axial pin 7 from the bore of the eccentric 8 and reinserting the same into this bore in a different angular position thereof.

A key element 21, the details of which are depicted in FIGS. 7 and 8 of the drawing, is arranged between the bearing sleeve 4 of the housing 5 and the actuating handle 1. The key element 21 is provided with a polygonal configuration. In the illustrated construction, the key element 21 has a square cross section. This key element 21 is received in a corresponding polygonal recess 22 of the actuating handle 1 and is in a positive engagement with the actuating handle 1 in this polygonal recess 22. There also exists the possibility to connect the external circumferential surfaces of the key element 21 by means of an adhesive to the inner circumferential surfaces bounding the polygonal recess 22 of the actuating handle 1. The key element 21, which is advantageously made of a synthetic plastic material, includes wall portions 23 which extend along arcuate courses. The wall portions 23 are in engagement with the bearing sleeve 4 which conically tapers towards its free end face. The wall portions 23, which act in a resilient manner, serve for additional support of the actuating handle 1. Any overdeterminations which may exist in the bearing area are elastically compensated for by the wall portions 23.

Figure 9:
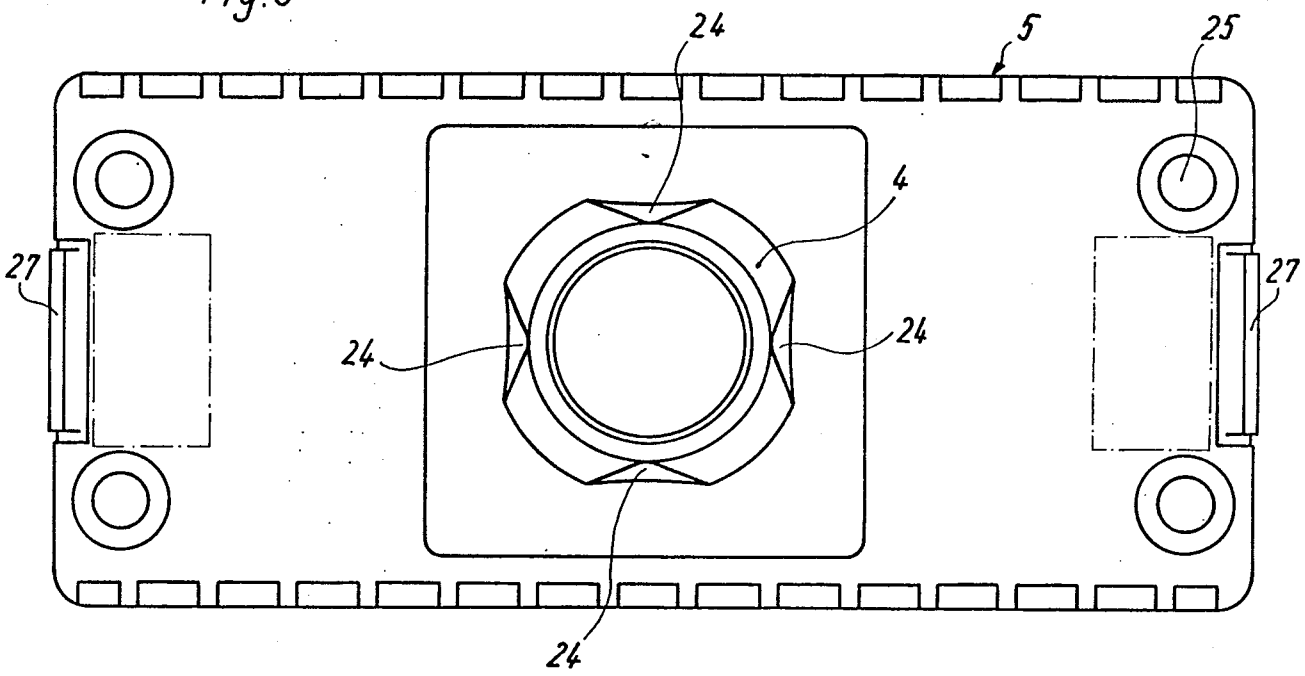
FIG. 9 is a top plan view of the housing of the arrangement of FIG. 1.

As shown in FIG. 9, the bearing sleeve 4 is provided with arresting recesses 24 which are arranged at angular distances of 90° and serve for engaging the resilient wall portions 23. In the respective positions I, II and III of the actuating handle 1, the arcuate resilient wall portions 23 are arrestingly received in the arresting recesses 24 of the bearing sleeve 4 and thus arrest the actuating handle 1 in the respective position I, II or III. Simultaneously, the operating personnel is given, by the arresting engagement of the wall portions 23 in the recesses 24, a signal that the desired position I, II or III of the actuating handle 1 and thus of the transmission has been reached. Each of the resilient arcuate wall portions 23 are deflected out of its rest or relaxed position by the application of only a relatively small force $F_1$ (see FIG. 8). However, corresponding to the lever ratio, correspondingly large pressing forces $F_2$ build up in the respective wall portion 23. These relatively high pressing forces $F_2$ provide for a good resilient returning and arresting action.

As also indicated in FIG. 9, the housing 5 is provided with pass-through channels 25 for connecting or mounting screws by means of which the housing 5 is secured to the casement frame beam. Subsequently to the mounting, a cap 26 which is shown in FIG. 4 of the drawing is slid over the actuating handle 1 and onto the housing 5 and secured to the housing 5 by arresting means. In the illustrated construction, the housing 5 is provided at its end faces with arresting tongues 27 which have arresting edge portions that engage in arresting recesses 28 of the cap 26. In order to be able to mount the cap 26, it is necessary that the region of its connection to the housing 5. The cap 26 is provided with a central opening 29 which is configured in correspondence with this greatest cross section of the actuating handle 1.

Inasmuch as the operative parts of the actuating handle 1, of the housing 5 and of the transmission, such as the housing 5 with the bearing sleeve 4, the actuating handle 1 with the bearing bolt 2 and the axial pin 7, and the slide 13 with the entraining member 14, as well as the eccentric 8, are made of a synthetic plastic material, special maintenance or servicing of these parts is dispensed with.

While the present invention has been described and illustrated herein as embodied in a specific construction of an actuating handle arrangement especially for window casements, it is not limited to the details of this particular construction, since various modifications and structural changes are possible and contemplated by the present invention. Thus, the scope of the present invention will be determined exclusively by the appended claims.

What is claimed is:

1. An arrangement for actuating door or window fittings of a turnable and/ tiltable door leaf or window casement structure, which are operated by a pusher bar, comprising a housing having a longitudinal axis;

an actuating handle mounted on said housing for turning about a turning axis; and a transmission accommodated in said housing and actuated by said actuating handle, said transmission including a slide centered on a central longitudinal axis, mounted in said housing for displacement along said longitudinal axis of said housing, and having an elongated guiding groove centered on a groove axis extending at an acute angle with respect to said central longitudinal axis of said slide, an eccentric connected to said actuating handle and equipped with an entraining pin which is received in said guiding groove of said slide for movement longitudinally of said guiding groove, said entraining pin having a central axis, said slide extending along an imaginary plane which is intersected by said turning and central axis at respective intersection points, and an entraining member secured to said slide, said actuating handle being switchable between a first position, a second position, and a third position, so that when said actuating handle is in said first and third positions a connecting line which connects said intersecting points extends at a right angle with respect to said longitudinal groove axis, and when said actuating handle is in the second position said longitudinal groove axis extends through the intersecting point of said turning axis with said imaginary plane whereby with a constant angular speed of said actuating handle a speed of said entraining member in said first and third positions goes to zero and in said second position reaches a maximum and with a constant torque at said actuating handle a force which acts on said entraining member in said first and third positions reaches a maximum and in said second position reaches a minimum.

2. A door or window unit, comprising a turnable and tiltable door leaf or window casement structure having door or window fittings, said structure having a closed position, a turning position, and a tilting position;

a pusher bar operating said turnable and tiltable door leaf or window casement structure; and an arrangement for actuating said door or window fittings, said arrangement including a housing having a longitudinal axis and mounted on said door leaf or window casement structure, an actuating handle mounted on said housing for turning about an axis, and a transmission accommodated in said housing and actuated by said actuating handle, said transmission including a slide centered on a central longitudinal axis, mounted in said housing for displacement along said longitudinal axis of said housing, and having an elongated guiding groove centered on a groove axis extending at an acute angle with respect to said central longitudinal axis of said slide, an eccentric connected to said actuating handle and equipped with an entraining pin which is received in said housing groove of said slide for movement longitudinally of said guiding groove, said entraining pin having a central axis, said slide extending along an imaginary plane which is intersected by said turning and central axis at respective intersecting points, and an entraining member secured to said slide and coupled with said pusher bar, said actuating handle being switchable between a first position which corresponds to said closed position of said structure, a second position which corresponds to said turning position of said structure, and a third position which corresponds to said tilting position of said structure, so that when said actuating handle is in said first and third positions of said structure and spaced from one another by 180° a connecting line which connects said intersecting points extends at a right angle with respect to said longitudinal groove axis, and when said actuating handle is in said second position corresponding to said turning position of said structure said longitudinal groove axis extends through said intersecting point of said turning axis with said imaginary plane, whereby with a constant angular speed of said actuating handle a speed of said entraining member in said first and third positions goes to zero and in said second position reaches a maximum and with a constant torque at said actuating handle a force which acts on said entraining member in said first and third positions reaches a maximum and in said second position reaches a minimum.

3. The arrangement as defined in claim 1, wherein said actuating handle includes a cylindrical bearing bolt centered on said turning axis and having a free end, and an axial pin extending beyond said free end of said bearing bolt, having a diameter smaller than said bearing bolt, and provided with external circumferential gear toothing; and wherein said eccentric includes a receiving bore for receiving said axial pin, said bore being provided with an internal circumferential gear toothing corresponding to said external gear toothing of said axial pin.

4. The arrangement as defined in claim 1, wherein said actuating handle includes a cylindrical bearing bolt centered on said turning axis and having a free end; and wherein said housing is provided with an integral bearing sleeve which is provided with a bearing bore for the bearing bolt and conically tapers toward said free end.

5. The arrangement as defined in claim 4, wherein said actuating handle further includes an axial pin extending beyond said free end of said bearing bolt; and wherein said transmission further includes a clamping disk mounted on said axial pin and having an outer edge portion which is in contact with said eccentric, and a screw which connects said clamping pin to said bearing bolt.

6. The arrangement as defined in claim 5, wherein each of said housing with said integral bearing sleeve, said actuating lever with said bearing bolt and said axial pin, said slide with said entraining member, and said eccentric, is of a synthetic plastic material.

7. The arrangement as defined in claim 4, and further comprising a key element of a synthetic plastic material arranged between said bearing sleeve of said housing and said actuating handle and connected to said actuating handle, said key element including resilient arcuate inwardly bulging wall portions which engage said bearing sleeve of said housing.

8. The arrangement as defined in claim 7, wherein said key element has a polygonal outer contour; and wherein said actuating handle is provided with a corresponding polygonal recess at the region of said bearing bolt.

9. The arrangement as defined in claim 8, wherein said polygonal contour has a square cross section.

10. The arrangement as defined in claim 8, wherein said polygonal recess is trapezoidal in axial section.

11. The arrangement as defined in claim 7, wherein said key element has outer surfaces and said polygonal recess is bounded by inner surfaces; and further including an adhesive layer connecting said inner and outer surfaces

12. The arrangement as defined in claim 7, wherein said bearing sleeve is provided with arresting recesses at locations which are spaced from one another by 90° for the engagement of said resilient wall portions.

13. The arrangement as defined in claim 1, and further comprising a cap having an opening for the passage of said actuating handle therethrough, and means for arresting said cap to said housing.

14. The arrangement as defined in claim 13, wherein said arresting means includes arresting recesses in said cap, and arresting tongues on said housing which engage in said arresting recesses of said cap.

15. The arrangement as defined in claim 1, wherein said housing has longitudinally extending grooves; and wherein said slide has lateral longitudinal surfaces and includes guiding webs at said lateral longitudinal surfaces thereof, said guiding webs extending into said longitudinally extending grooves of said housing.

16. The arrangement as defined in claim 15, wherein said housing has arresting ledges which engage under the guiding webs of said slide.

17. The arrangement as defined in claim 1, wherein said transmission further includes a roller which is constituted by a metallic ring and is rotatably supported on said entraining pin.

* * * * *